US005203572A

United States Patent [19]

Lirn

[11] Patent Number: 5,203,572

[45] Date of Patent: Apr. 20, 1993

[54] TARGET FOR SUCTION CUP AND HOOK-AND-LOOP PROJECTILES

[76] Inventor: Poh-Weei Lirn, No. 32, Alley 37, Lane 267, Sec. 2 Tien-Hsin Rd., Feng-Yuan City, Taichung Hsien, Taiwan

[21] Appl. No.: 784,373

[22] Filed: Oct. 29, 1991

[51] Int. Cl.[5] ..... A63B 67/00

[52] U.S. Cl. ..... 273/344; 273/346; 273/412

[58] Field of Search ..... 273/412, 344, 346

[56] References Cited

U.S. PATENT DOCUMENTS

| | | | |
|---|---|---|---|
| 2,745,666 | 5/1956 | Swartz | 273/344 |
| 3,378,260 | 4/1968 | Hartel | 273/344 |
| 4,017,076 | 4/1977 | Bai | 273/346 |
| 4,735,420 | 4/1988 | Seidler | 273/412 |
| 4,832,348 | 5/1989 | Exel | 273/344 |
| 4,995,617 | 2/1991 | Lee | 273/346 |
| 5,066,017 | 11/1991 | Kurland | 273/344 |
| 5,080,374 | 1/1992 | Yu | 273/346 |

*Primary Examiner*—William H. Grieb

[57] ABSTRACT

A target is used to catch a first projectile having a suction cup on one end and a second projectile having VELCRO hook and loop fastening material provided thereon. The target includes a pan member, an elastic foam layer, an adhesion surface, and a flexible strap. The pan member confines a receiving space and has a closed side provided with a flat suction surface to which the suction cup of the first projectile releasably adheres, an opposite open side to access the receiving space, and a peripheral wall provided with a pair of oppositely disposed radial ears. The elastic foam layer is provided in the receiving space. The adhesion surface includes a textile sheet having a periphery sealed to the peripheral wall of the pan member so as to cover the open side of the pan member, and a hairy outer surface to which the Velcro hook and loop fastening material of the second projectile releasably adheres. The flexible strap has two ends which releasably engage the radial ears of the pan member.

3 Claims, 5 Drawing Sheets

TARGET FOR SUCTION CUP AND HOOK-AND-LOOP PROJECTILES

BACKGROUND OF THE INVENTION

1. Field of the Invention

The invention relates to a target, and more particularly to a target which can be used with two different types of projectiles.

2. Description of the Related Art

A first example of a conventional target is shown in FIG. 1A. One end of a dart 2 is provided with a suction cup 20 which can adhere to a flat front surface of the conventional target 1 when the dart 2 is thrown toward the flat front surface of the target 1. The target 1 has a rear surface provided with a handle 3 to facilitate carrying the same.

A second example of a conventional target is shown in FIG. 1B. A Velcro hook and loop fastening material 5 covers a front open end of the conventional target 4. The target 4 has a rear surface provided with a handle 6 to facilitate carrying the same. A ball 7, covered with wool fabric, can be thrown toward the target 4 so as to adhere to the VELCRO hook and loop fastening material 5.

The above described conventional targets and projectiles are used in games played by two people, one of whom throws the projectile, while the other one holds the target with the aim of catching the projectile.

Note that in both conventional targets, only one side can be used to catch the projectile. The other side of the conventional targets is provided with a handle for carrying the target. Note also that the conventional targets can catch only one type of projectile.

Another drawback of the conventional target shown in FIG. 1B is that it is relatively difficult to provide decorations on the VELCRO hook and loop fastening material. Presently, the VELCRO hook and loop fastening material is painted with different colors to decorate the target and enhance its aesthetic appeal. Another known method is to provide strips of VELCRO hook and loop fastening material on a textile sheet so as to form a three-dimensional image on the latter. This method is relatively complicated and thus, the cost of a target which employs this method is relatively expensive.

SUMMARY OF THE INVENTION

Therefore, the main objective of the present invention is to provide a target which can be used to catch two different types of projectiles.

More specifically, the main objective of the present invention is to provide a target that has a flat suction surface to which a suction cup of a dart can adhere, and an opposite adhesion surface to which a ball having a VELCRO hook and loop fastening material provided thereon can adhere.

Accordingly, the preferred embodiment of a target of the present invention is used to catch a first projectile having a suction cup on one end and a second projectile having VELCRO hook and loop fastening material provided thereon, and comprises: a pan member confining a receiving space and having a closed side provided with a flat suction surface to which the suction cup of the first projectile can releasably adhere, an opposite open side to access the receiving space, and a peripheral wall provided with a pair of oppositely disposed strap retaining means; an elastic foam layer provided in the receiving space; an adhesion surface including a textile sheet having a periphery sealed to the peripheral wall of the pan member so as to cover the open side of the pan member, and a hairy outer surface to which the VELCRO hook and loop fastening material of the second projectile can releasably adhere; and a flexible strap having two ends, each being provided with an anchor means to releasably engage the strap retaining means of the pan member.

The elastic foam layer has one side, disposed adjacent to the textile sheet, which is provided with an embossed decorative image that is impressed upon the textile sheet. This enhances the aesthetic appeal of the target of the present invention.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1A:
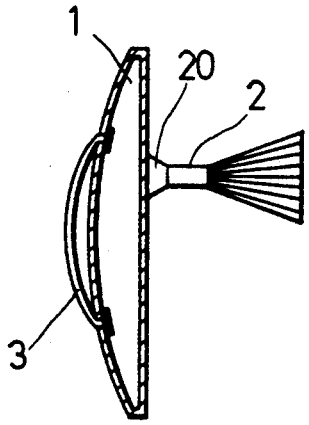
FIG.1A PRIOR ART
FIG. 1A is an illustration of a conventional target which is used with a dart that has a suction cup on one end.

Referring to FIGS. 2 through 5B, the first preferred embodiment of a target according to the present invention is shown to comprise a pan member 10, an elastic layer 22, an adhesion surface 20, and a flexible strap 30.

The pan member 10 is an integral plastic piece which is formed during a conventional molding process (such as injection molding). The pan member 10 has a closed side that is provided with flat suction surface 11. A suction cup 41, disposed on one end of a dart 40, releasably adheres to the pan member 10 at the flat suction surface 11 (Refer to FIG. 5B). The pan member 10 confines a receiving space 12. The pan member 10 is further provided with a pair of oppositely disposed strap retaining means 13. Each of the strap retaining means 13 includes a radial ear 131 projecting outwardly from the peripheral wall of the pan member 10. The ear 131 is formed with a slot 132.

The elastic layer 22 is preferably made of PVC foam and is provided inside the receiving space 12 of the pan member 10. The adhesion surface 20 includes a textile sheet 21 (such as wool) which covers the receiving space 12. The textile sheet 21 has a hairy outer surface 211. High frequency sealing is used to join the periphery of the textile sheet 21 to the peripheral wall of the pan member 10. A ball 50, whose surface may be partially or entirely covered with Velcro hook and loop fastening material 51, is thrown toward the elastic layer 22 so as to adhere to the hairy surface 211 (Refer to FIG. 5A). The preferred embodiment undergoes a thermal die forming operation in order to join one side of the elastic layer 22 with the inner side of the textile sheet 21. The elastic layer 22 is embossed with a decorative image during the die forming operation. The embossed image is impressed upon the textile sheet 21, as shown in the FIGS. 3A and 3B. This enhances the aesthetic appeal of the target of the present invention.

The strap 30 has two ends which releasably engage the pan member 10 at the slot 132 of the ears 131. The length of the strap 30 is longer than the distance between the ears 131 to facilitate the attachment of the strap 30 onto the pan member 10. An anchor means 31 is provided on each end of the strap 30. The anchor means 31 includes a resilient hook projection 311.

To attach the strap 30 onto the pan member 10, each of the anchor means 31 is inserted into the slot 132 of the respective one of the ears 131, thereby pressing the hook projection 311 against the surface of the strap 30. The combined thickness of the strap 30 and the hook projection 311 must be smaller than the width of the slot 132 to facilitate the insertion of the anchor means 31 into the slot 132. When the anchor means 31 has moved past the slot 132, the hook projection 311 expands to engage the peripheral wall of the pan member 10 and thus prevent the untimely release of the strap 30 from the pan member 10. The strap 30 is gripped by the user when carrying the target of the first preferred embodiment. To detach the strap 30 from the pan member 10, the hook projection 311 is pressed against the surface of the strap 30 and the anchor means 31 is pulled through the slot 131 so as to disengage from the ear 131.

Figure 5A:
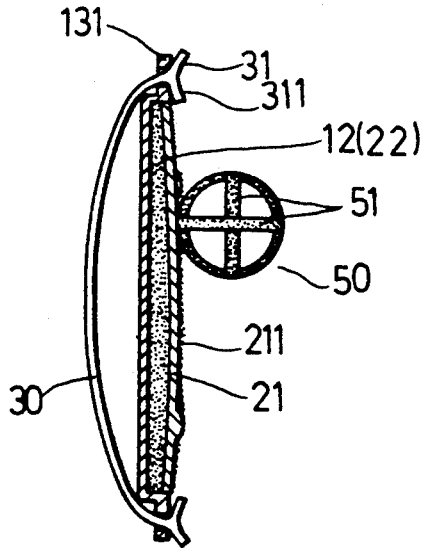
FIG. 5A is an illustration of the preferred embodiment of a target according to the present invention when used with a ball that has VELCRO hook and loop fastening material provided thereon.
Figure 5B:
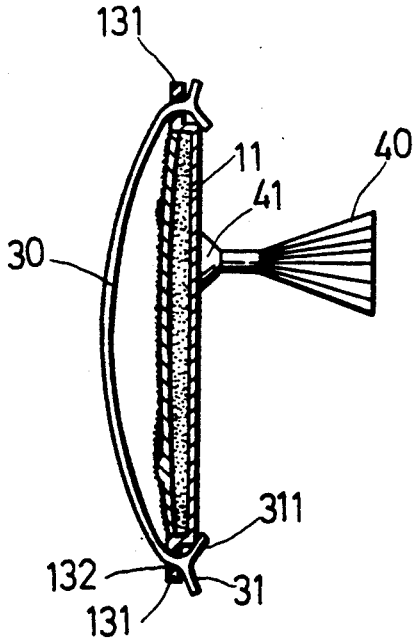
FIG. 5B is an illustration of the preferred embodiment when used with a dart that has a suction cup on one end.

Referring to FIG. 5A, the strap 30 is attached to the pan member 10 such that it is disposed adjacent to and extends along the suction surface 11 when the target is used to catch the ball 50. Referring to FIG. 5B, the strap 30 is attached to the pan member 10 such that it is disposed adjacent to and extends along the adhesion surface 20 when the target is used to catch the dart 40.

Figure 1B:
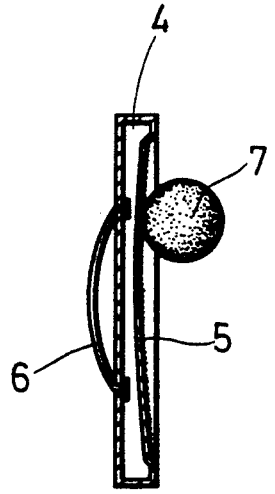
FIG.1B PRIOR ART
FIG. 1B is an illustration of another conventional target which is used with a ball that has wool fabric provided thereon.
Figure 2:
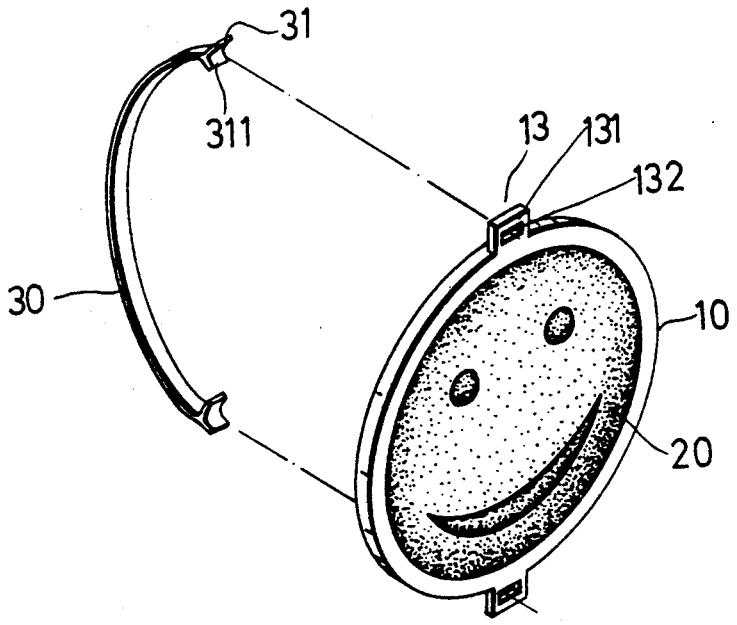
FIG. 2 is a perspective view of the first preferred embodiment of a target according to the present invention.
Figure 4:
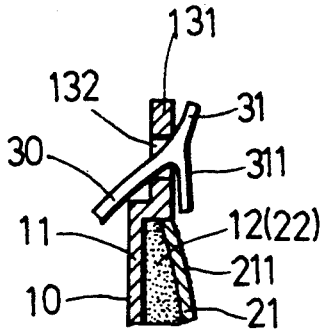
FIG. 4 is an illustration of an anchor means and a strap retaining means of the first preferred embodiment.
Figure 3A:
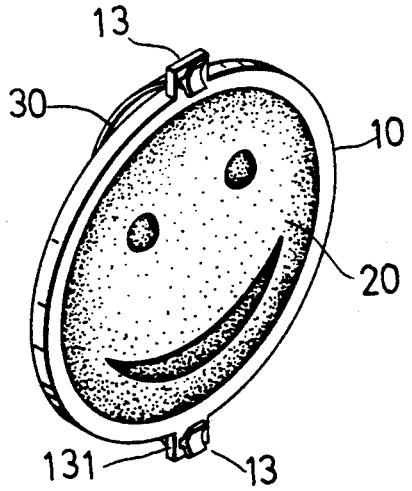
FIG. 3A illustrates a first decorative image that can be formed on the first preferred embodiment.
Figure 3B:
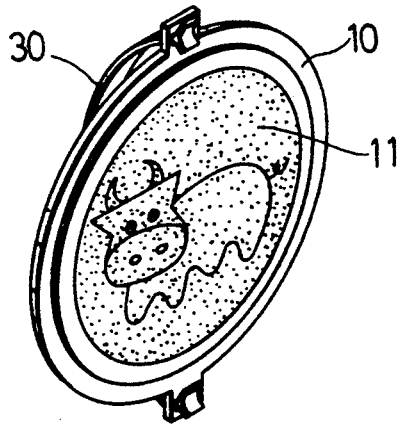
FIG. 3B illustrates a second decorative image that can be formed on the first preferred embodiment.

The target of the present invention combines the flat suction surface of the conventional target shown in FIG. 1A and the adhesion surface of the conventional target shown in FIG. 1B in a single pan member. This permits the target to catch two different types of projectiles, thereby extending the enjoyment gained when using the present invention. The elastic layer 22 may be provided with a variety of embossed decorative images so as to enhance the aesthetic appeal of the target.

Figure 6:
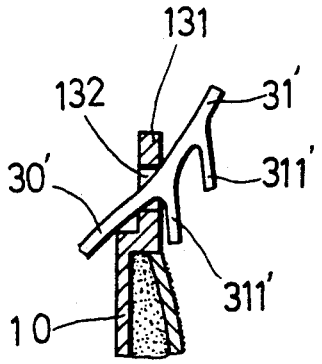
FIG. 6 is an illustration of an anchor means and a strap retaining means of the second preferred embodiment of a target according to the present invention.

Referring to FIG. 6, the second preferred embodiment of a target according to the present invention is shown to be substantially similar to the first preferred embodiment. The difference between the two embodiments resides in the construction of the strap 30'. The strap 30' has two ends (only one is shown) which releasably engage the pan member 10 at the slot 132 of the ears 131. An anchor means 31' is provided on each end of the strap 30'. The anchor means 31' includes a series of spaced resilient hook projections 311' (only two hook projections 311' are shown). A selected one of the hook projections 311' engages the peripheral wall of the pan member 10 so that the length of tee strap 30' between the ears 131 may be adjusted to correspondingly vary the space between the pan member 10 and the strap 30'. Adjustment of the space between the pan member 10 and the strap 30' permits the target to be suited for use by both children and adults.

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. A target for catching a first projectile having a suction cup on one end and a second projectile having VELCRO hook and loop fastening material provided thereon, comprising:

a pan member confining a receiving space and having a closed side provided with a flat suction surface to which said suction cup of said first projectile can releasably adhere and an opposite open side to access said receiving space, said pan member further having a peripheral wall provided with a pair of oppositely disposed strap retaining means;

an elastic foam layer provided in said receiving space;

an adhesion surface including a textile sheet having a periphery sealed to said peripheral wall of said pan member so as to cover said open side of said pan member, and a hairy outer surface to which said VELCRO hook and loop fastening material of said second projectile can releasably adhere; and a flexible strap having two ends, each being provided with an anchor means to releasably engage said strap retaining means of said pan member.

2. The target as claimed in claim 1, wherein each of said strap retaining means comprises a radial ear projecting outwardly from said peripheral wall of said pan member, said ear being formed with a slot; said anchor means including a resilient hook projection that extends through said slot of one of said strap retaining means so as to engage said peripheral wall of said pan member and thus prevent the untimely release of said strap from said pan member.

3. The target as claimed in claim 1, wherein said elastic foam layer has one side disposed adjacent to said textile sheet and provided with an embossed decorative image that is impressed upon said textile sheet.

* * * * *